United States Patent [19]

Aitken

[11] 4,371,368

[45] Feb. 1, 1983

[54] METHOD AND APPARATUS FOR THE MANUFACTURE OF FUSECORD

[75] Inventor: Robert M. Aitken, Stevenston, Scotland

[73] Assignee: Imperial Chemical Industries Limited, London, England

[21] Appl. No.: 109,903

[22] Filed: Jan. 7, 1980

[30] Foreign Application Priority Data

Jan. 24, 1979 [GB] United Kingdom ..... 7902492

[51] Int. Cl.[3] ..... C06C 5/08

[52] U.S. Cl. ..... 493/298; 57/8; 86/22; 493/300; 493/948

[58] Field of Search ..... 93/78, 77 FT, 77 CL, 93/80, 94 R, 77 R, 1 F; 53/548–550, 450; 102/27 R; 86/22, 1 R; 493/948, 300, 301, 299, 298, 297; 57/8

[56] References Cited

U.S. PATENT DOCUMENTS

| | | | |
|---|---|---|---|
| 37,079 | 12/1862 | Wren et al. | 57/8 |
| 1,023,142 | 4/1912 | Ellsworth | 86/22 X |
| 1,433,242 | 10/1922 | Shardlow | 57/16 |
| 2,390,454 | 12/1945 | Murphy | 57/18 |
| 3,435,764 | 4/1969 | Kelly et al. | 102/27 R |
| 3,623,266 | 11/1971 | Nakayama | 53/550 X |
| 3,796,126 | 3/1974 | Turner | 93/78 X |

FOREIGN PATENT DOCUMENTS

| | | |
|---|---|---|
| 295266 | 8/1928 | United Kingdom . |
| 844442 | 8/1960 | United Kingdom . |
| 1160318 | 8/1969 | United Kingdom . |
| 1221346 | 2/1971 | United Kingdom . |
| 1345233 | 1/1974 | United Kingdom . |
| 1365487 | 9/1974 | United Kingdom . |
| 1403721 | 8/1975 | United Kingdom . |

*Primary Examiner*—James F. Coan

*Attorney, Agent, or Firm*—Cushman, Darby & Cushman

[57] ABSTRACT

In the manufacture of explosive fusecord stranded reinforcing wrapping material is helically spun around an encased fusecord core by advancing the fusecord core axially through at least one supply reel of wrapping material and training at least one strand of wrapping material from the reel around the fusecord core by means of a driven flyer rotating around the fusecord core. Strands of wrapping material may be trained from two or more supply reels preferably mounted in line co-axially with the path of the fusecord core. The method permits faster production than can be achieved by the conventional method wherein the wrapping material is applied from supply reels rotating orbitally around the path of the fusecord core.

7 Claims, 7 Drawing Figures

METHOD AND APPARATUS FOR THE MANUFACTURE OF FUSECORD

This invention relates to a method and apparatus for the manufacture of explosive fusecord. The invention is useful for both incendiary and detonating fusecords.

In one widely used dry spinning process for fusecord manufacture a thin carrier tape of paper or synthetic plastics material is drawn in a vertically downward path through a guide tube wherein the tape is progressively convoluted into the form of a tube (herein termed the carrier tube) with the tape edges overlapping. Dry particulate explosive material, for example, pentaerythritol tetranitrate is continuously fed from a hopper through a nozzle or aperture into the end of the formed tube to form the explosive core of the fusecord, and the encased core is consolidated by passing the tube through compression dies and by helically winding (spinning) strands of wrapping material, for example, yarns or tapes, around the tube. An outer sheath of waterproof thermoplastics material is then extruded over the wrapping material. Although various modifications of this method have been proposed from time to time the method generally used is that described, for example, in United Kingdom Patent Specification No. 1,345,233. In this method the diameter of the aperture through which the explosive flows into the carrier tube cannot greatly exceed the diameter of the carrier tube and this diameter restriction limits the rate of flow of explosive material into the tube and consequently restricts the production rate from any given fusecord manufacturing machine. Thus if the production rate is increased beyond a critical maximum by increasing the draw rate of the carrier tape, insufficient explosive powder will be fed into the carrier tube to form the desired explosive core. Moreover, the explosive material tends to 'bridge' in the narrow aperture giving rise to non-uniform flow even at draw speeds lower than the critical maximum. In practice, therefore, the conventional dry spinning fusecord manufacturing apparatus is not capable of sustained production rates much above 20 meters per minute.

However we have devised a method of feeding explosive powder into a carrier tube of convoluted tape which enables the core of explosive fusecord to be formed at a much higher speed. The method, which is described in our copending United Kingdom patent application No. 7,902,492 involves continuously advancing a carrier tape in a horizontal linear path, partially convoluting said tape to form a longitudinal open trough portion extending over a feed zone of said path, continuously feeding a stream of explosive material into said trough portion at a controlled rate appropriate to the formation of the desired explosive core, said stream being elongated and extending longitudinally over a portion of said feed zone, further convoluting said tape in a zone subsequent to said feed zone to form a closed tube surrounding and conveying a core of explosive material and subsequently applying reinforcing materials around the said closed tube.

The preferred method of feeding the explosive material comprised forming a substantially uniform layer of powdered explosive material, continuously advancing said layer to the feed zone at a controlled rate, for example, on a conveyor such as a belt or vibratory conveyor disposed at an angle to the carrier tape path, and permitting explosive material to fall continuously from the leading edge of said layer into the open trough-shaped tape portion. The explosive material feed rate was advantageously controlled by monitoring the weight per unit length in the fusecord core and adjusting the relative speeds of advance of the explosive layer and the carrier tape in response to any variation from the weight nominally required for the desired explosive core. In practive a constant carrier tape speed was maintained and the speed of the explosive layer was adjusted.

We have found that higher fusecord production speed commensurate with the higher speed of formation of the wrapped explosive fusecord core could not be realised using the conventional method of applying strands of wrapping material around the carrier tube encasing the explosive core. The conventional method involves spinning several strands of wrapping material simultaneously from supply reels mounted on one or more platforms and orbitally rotating around the fusecord path as described in United Kingdom Patent Specification No. 1,345,233. At the high speed the revolving platform and the orbital supply reels tend to get out of balance and cause excessive vibration and stress of the platform. Reduction in the weight of the wrapping material on the reels to counter this effect necessitates frequent interruption of production for replacement (or replenishment) of the reels on the platform. Also, at higher speeds the strands of wrapping material frequently break.

It is an object of this invention to provide an improved method of applying reinforcing wrapping material to explosive fusecord which allows higher speed fusecord production.

In order to avoid excessive imbalance of the supply reels we have found it advantageous to mount the reels in line co-axially with the path of the carrier tape, so that in operation the embryo fusecord passes through the centre of each reel.

In accordance with this invention a method of helically spinning stranded reinforcing wrapping material on explosive fusecord comprises continuously advancing an encased fusecord core to which the reinforcement is to be applied along a path axially through at least one supply reel of wrapping material and training at least one strand of wrapping material from the said reel around the said encased fusecord core by means of a driven flyer rotating around the encased fusecord core. Conveniently the reel is mounted freely on a hub so that it is rotated around its longitudinal axis by the flyer pulling the strand of wrapping material. In this spinning method the centrifugal forces on the reels are always balanced so that large reels may be used and stoppages for renewal or replenishment of the reels and the repair of broken strands are less frequent. A further advantage is that wrapping material in the form of tape can be spun on fusecord without twist whereas twist can only be avoided in the conventional method by employing special winding methods to fill the tape supply reels. In practice the strands of wrapping material from some reels will be spun in one direction and the remainder in the counter direction, the number and direction of the strands being chosen as required to give the desired strength, bending resistance and finish to the fusecord.

The apparatus of the invention comprises draw means to advance an encased fusecord core of explosive material along a linear path, one or more reels of stranded wrapping material each reel having a tubular centre and being mounted for rotation around an axis coaxial with said path and, in association with each reel, a rotatably driven flyer guide adapted to train one or more strands of wrapping material from its associated reel helically around the encased fusecord core as the encased core passes axially through the reel and to rotate said associated reel by the pull on the wrapping material. Conveniently the flyer is fixed to a driven hub on which one or more reels is freely rotatable said hub having an axial bore through which in operation the encased explosive core passes.

Preferably the draw means is adapted to advance the encased explosive core in a horizontal path and the reels are mounted for rotation around a horizontal axis. When the apparatus comprises two or more reels the reels are preferably mounted co-axially in line. It is also preferred that a shaping die for the spunwrapped fusecord core should be accommodated co-axially with the reel at the position where the wrapped core enters the reel.

The draw means preferably comprises one or more driven rollers adapted to engage the wrapped fusecord and advance it at a substantially uniform speed.

The invention is further illustrated by the preferred embodiment which is hereinafter described, by way of example, with reference to the accompanying drawings wherein FIG. 1 shows diagrammatically in plan fusecord being manufactured in apparatus in accordance with the invention;

In the drawings like parts are designated by the same numeral.

Figure 1:
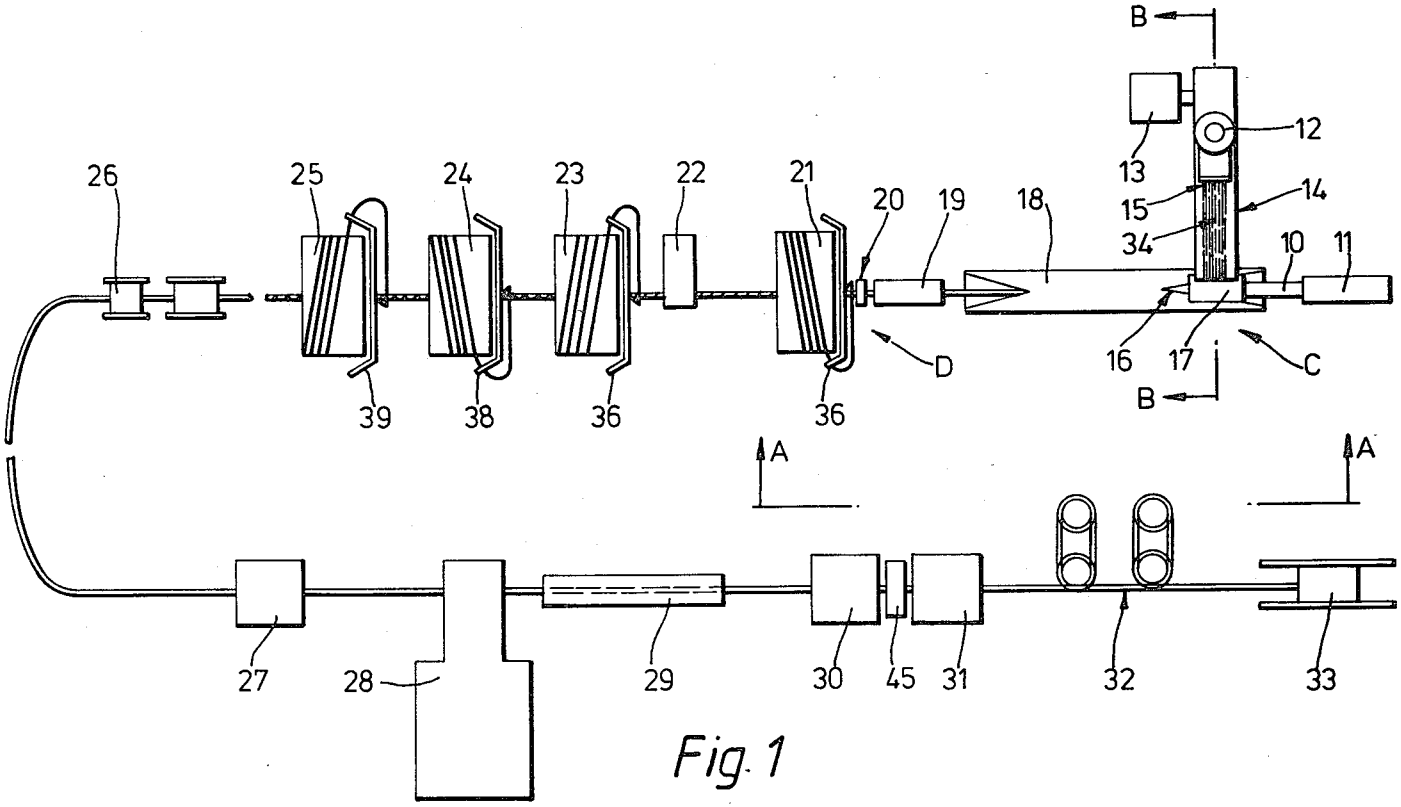
Figure 2:
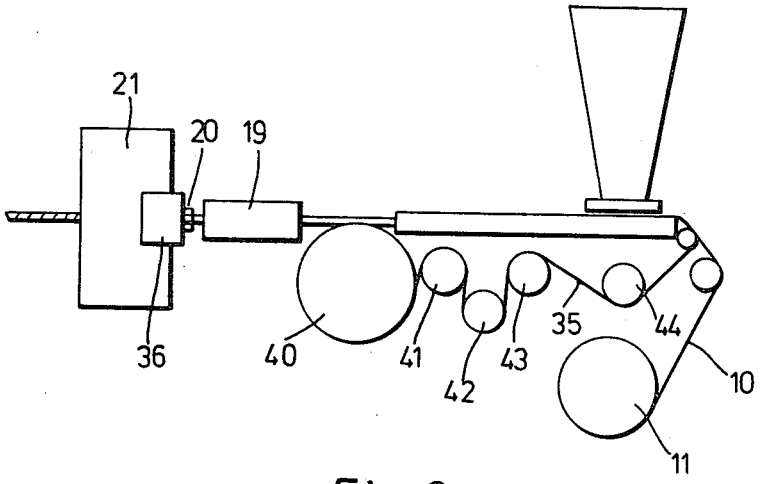
FIG. 2 shows diagrammatically in elevation a portion of the apparatus on the line AA of FIG. 1.
Figure 3:
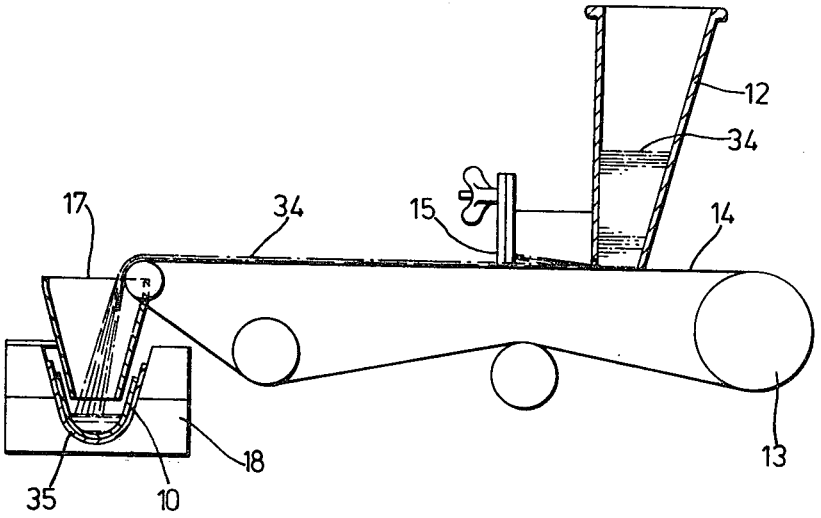
FIG. 3 shows diagrammatically in sectional elevation a portion of the apparatus on the Line BB of FIG. 1.
Figure 4:
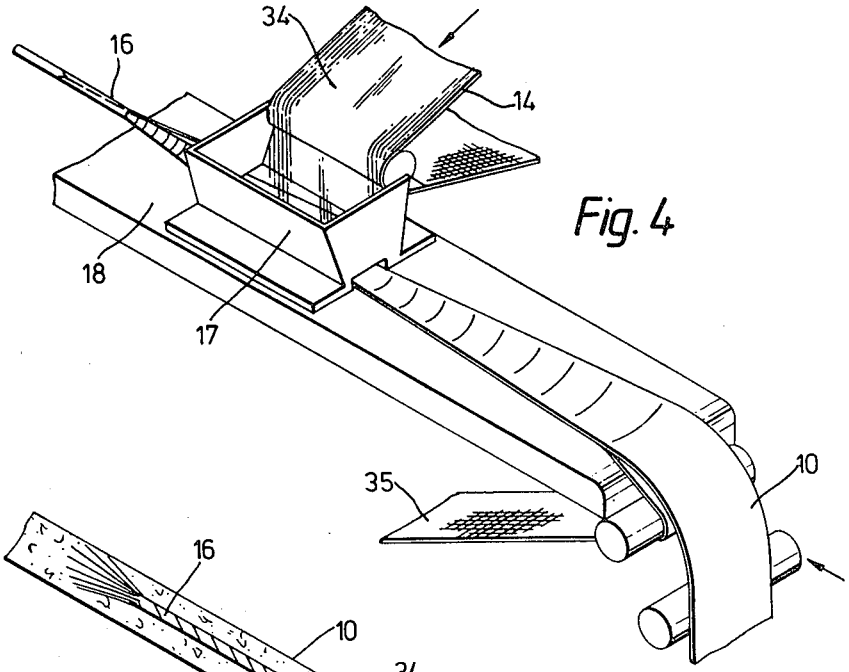
FIG. 4 is a fragmentary view in perspective in the direction of Arrow C in FIG. 1.
Figure 5:
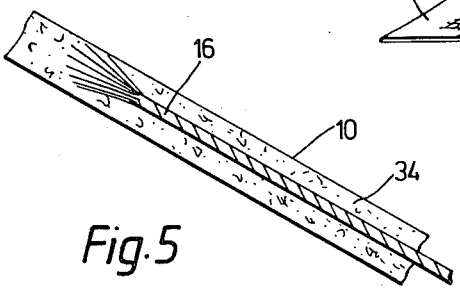
FIG. 5 is a fragmentary view in perspective of part of FIG. 4 on larger scale.
Figure 6:
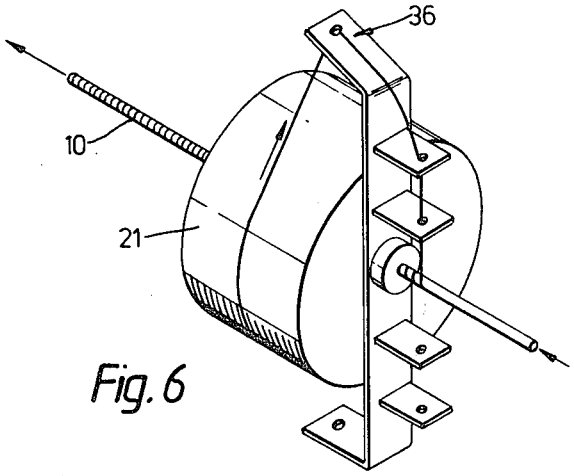
FIG. 6 is a fragmentary view in perspective of a flyer and reel assembly along the Arrow D in FIG. 1.

In the manufacture of explosive fusecord as shown in the drawings a carrier tape 10 is drawn by draw gear 26 from a reel 11 at a substantially constant speed through a tube-forming device 18 wherein the tape 10 is formed into an open trough of U-shaped cross-section. Explosive powder 34 is continuously discharged from the forward end of conveyor belt 14 into the trough portion of tape 10. The explosive powder drops freely from the forward edge of the conveyor belt 14 into the trough portion of tape 10 wherein the powder accumulates progressively over the length of tape below the end of the conveyor belt.

As the tape 10 is drawn further into the tube forming device 18 it is closed and overlapped into a tubular form containing a central core of explosive powder 32. A spreader 16 comprising a length of braided wire having a teased-out end portion is attached to the guide 17 and located in the powder stream in the open trough portion of the carrier tape forward of the end of the conveyor belt 14 and extending into the fully closed tube.

In its passage through the tube forming device 18 the tape 10 is supported on an auxiliary transport belt 35 of cotton or similarly strong material which is trained around driven roller 40, guide rolls 41, 42, 43 and 44 and through the tube forming device 16 wherein it conforms in shape to the tape 10. The belt 35 is driven at substantially the same rate as the tape 10 but the frictional contact between the tape 10 and belt 35 is such as to allow slight slippage, thereby enabling the tape 10 to be continuously under tension. With this arrangement any excessive stressing which might break the tape 10 is taken by the belt 35. At the end of the tube forming device 18 the tubular tape 10 leaves the transport belt 35 and is fed into a tube guide 19 wherein the now tubular tape 10 is maintained in its overlapped form and the powder 34 is consolidated. On emerging from the guide 19 the tubular tape 10 is drawn axially through a die 20 to shape the wrapped fuse core to the desired shape and diameter and then through the centres of reels 21, 23, 24 and 25 which are freely mounted on hollow driven hubs each reel containing either one strand or several strands of wrapping material. The strands are removed from the reels by driven rotatable flyers 36, 37, 38 and 39 attached to the hubs and the yarn wrapped around the tubular tape 10 at a fixed rate to provide an even covering on the tubular tape 10. The wrapping material can be counter-spun as desired to give, for example, different finishes, strengths or bending characteristics to the fusecord. A measuring device 22, which is conveniently a Beta-ray monitor, is situated after the reel 21 to measure the cord density. Since the strands of wrapping material are substantially constant in density the measurements indicate the powder charge variation and any slight changes in the charge are rectified by adjusting the belt speed control 13 in response to the measured core density.

Figure 7:
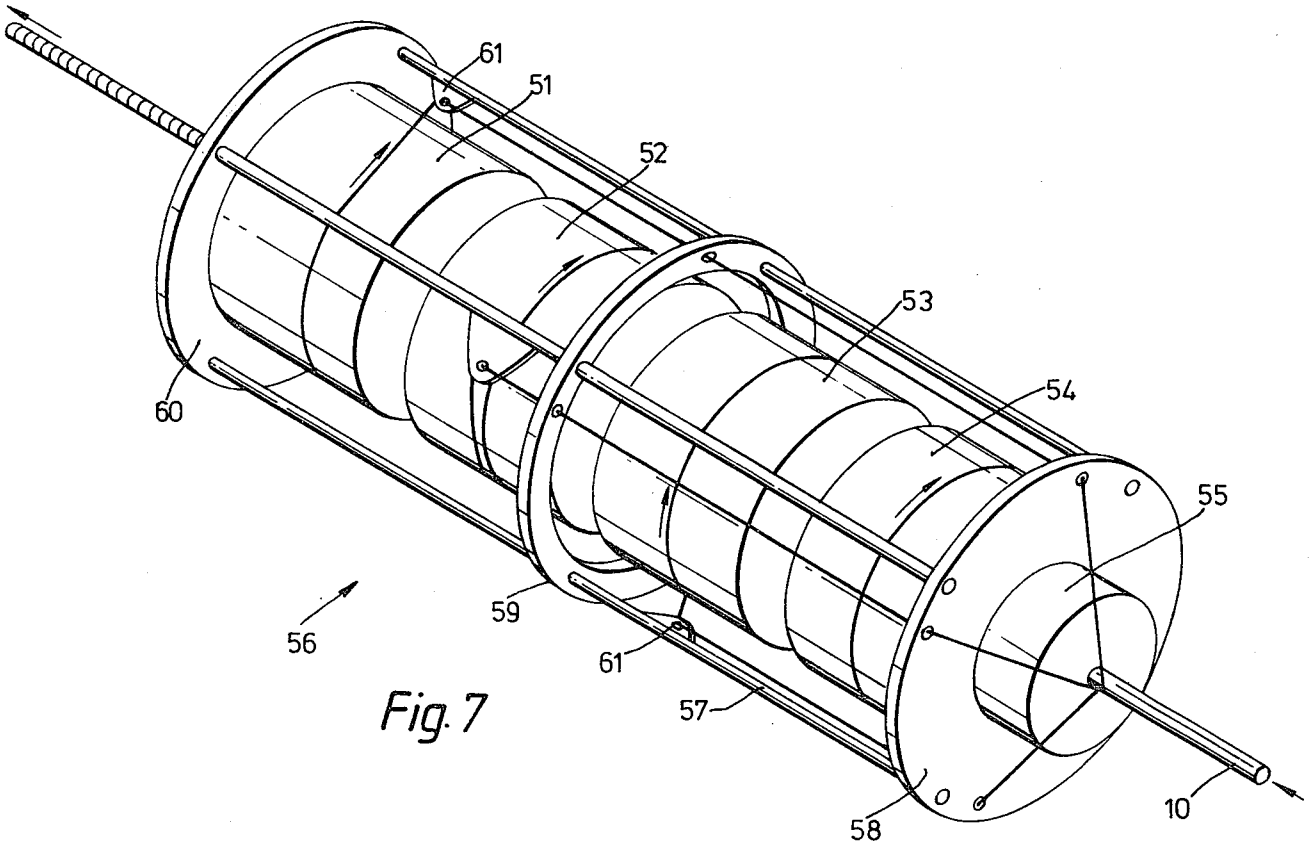
FIG. 7 shows in perspective a modified flyer and reel assembly alternative to that of FIG. 6.

In an alternative and more compact flyer and reel assembly shown in FIG. 7 a number of reels 51, 52, 53 and 54 and freely mounted for rotation on a tubular driven hub shaft 55. The flyer assembly 56 attached to the hub shaft 55 comprises hollow outer guide bars 57 having eyelets 61 through which the strands of wrapping material are threaded. The guide bars 57 are supported on the hub shaft 55 by discs 58, 59 and 60.

Both flyer 56 and hub shaft 55 are driven and, as the strands of wrapping material are helically wound around the tubular tape 10, the reels are pulled by the wrapping material and rotated in the same direction as the hub shaft 55 but at a slightly higher speed.

This alternative assembly becomes more advantageous as the number of reels is increased because it facilitates better control of the positioning of the strands of wrapping material on the fusecord.

The wrapped fusecord next passes the draw-gear 26 and subsequently it is drawn by draw-gear 31 through a detonation trap 27 and an extruder 28 wherein the cord is covered with a synthetic thermoplastics sheath. The draw speed of draw-gear 31 is matched to the speed of draw-gear 26 but small fluctuations in the relative speeds are accommodated by a tensioning device 45. The two draw-gears are used in order to reduce the degree of stretch which might be obtained over the long length of thin fusecord being processed.

After the extruder 28 the cord is drawn by draw-gear 31 through a water bath 29 where it is cooled and through a further detonation trap 30. After passing the draw-gear 31 the cord is fed to a further accumulator 32 and then to a driven storage reel 33. Sufficient fusecord can be stored in the accumulator 32 to permit the reels 33 to be changed without stopping the production line. The reel 33 is driven through a slippage device to allow the rotational speed of the reel to alter as fusecord is progressively wound onto the reel without altering the main driving speed whilst allowing a fairly constant torque to be applied to the reel to enable the fusecord to be neatly laid on the reel. If desired the reel 33 may be a small reel on which fusecord is wound for dispatch, but in this case several reel driving heads and a change-over device would be necessary in order to give the operator time to remove the full reels and put on empty reels.

The accumulator 32 comprises sets of pulleys over which the yarn passes, the centre of the pulleys being adjustable in spacing so that a varying length of fuse can be contained between the pulleys.

Each of the draw-gears 26 and 31 comprises a capstan around which the cord is wrapped so that it is frictionally engaged by the capstan. The relative speeds of the draw-gears 26 and 31 are balanced by adjustment of draw-gear 31 by a tension device 45.

The rate of all the items of the production line can be varied individually but during a production run the relative rates of all items will remain fixed.

On completion of a run the supply reels of wrapping material and carrier tape become empty at approximately the same time. The following change procedure is then adopted.

The extruder 29, the powder feed, the flyer drive, and draw-gears and the reel drive (to reel 33) are stopped. A new tape 10 is fitted and the old one removed. The reels 21, 23, 24 and 25 are all replaced and a wire is put through all items. The new tape 10 and all new strands of wrapping material are tied in turn to the wire as it is pulled through the centre of all items until a full set of wrapping strands and carrier tape is pulled clear at the draw-gear 26. The embryo fusecord (semi-fuse) is now tied to the end of the cord just completed with a small knot to allow it to pass through the extruder die and the complete line run at low speed until the knot has passed through the extruder die. The powder is then re-started and the cord again run until properly filled cord reaches the extruder. The extruder is then restarted and the whole line run up to desired speed.

I claim:

1. A method of helically spinning stranded reinforcing wrapping material on explosive fusecord comprising continuously advancing an encased fusecord core along a horizontal path axially through a plurality of supply reels on each of which wrapping material is wound coaxially with said horizontal path, said reels being spaced apart and freely mounted for rotation about a common axis, and training at least one strand of wrapping material from each reel helically around the said encased fusecord core by engaging the strand with a flyer rotatable around the encased fusecord and rotatably driving the flyer and the reel at the respective rotational speeds required to wrap the desired amount of wrapping material on the advancing fusecord.

2. A method as claimed in claim 1 wherein two or more of said supply reels are freely mounted on a common hub.

3. A method as claimed in claim 1 wherein each reel is mounted freely on a rotatably driven tubular hub to which the respective flyer is fixed, the reels being rotated by the combined impulsion from the frictional drive from the respective hub and the pull from the strand of wrapping material.

4. An apparatus for helically spinning stranded reinforcing wrapping material on explosive fusecord comprising draw means to advance an encased fusecord core of explosive material along a horizontal linear path, a plurality of reels on each of which stranded wrapping material is wound coaxially with said path, said reels being spaced apart and each reel having a tubular centre and being freely mounted for rotation around a horizontal axis co-axial with said path and, in association with each reel, a flyer guide rotatable about said path, each of said flyer guides having strand-engaging means for training one or more strands of wrapping material from its associated reel helically around the encased fusecord core as the encased core passes axially through the reel, and means for rotatably driving said flyer guides and said reels at the respective rotational speeds required to provide the desired amount of wrapping material on the advancing fusecord.

5. An apparatus as claimed in claim 4 wherein the flyer is fixed to a driven hub on which said reels are freely rotatable, said hub having an axial bore through which in operation the encased explosive core passes, said reels in operation being rotated by means of the combined impulsion from the frictional drive from the hub and the pull from the strand of wrapping material.

6. An apparatus as claimed in claim 5 wherein two or more of said reels are freely mounted for free rotation on driven hub.

7. An apparatus as claimed in claim 6 including comprising a shaping die for the spunwrapped fusecord core accommodated co-axially with the supply reels at the position where the wrapped core enters the first reel.

* * * * *